US006585343B2

(12) United States Patent
Bauer

(10) Patent No.: US 6,585,343 B2
(45) Date of Patent: Jul. 1, 2003

(54) SYSTEM AND METHOD FOR USING PULSE OR TRICKLE WARMING TO CONTROL NEUTRAL COLOR BALANCE ON A PRINT MEDIA

(75) Inventor: Stephen W. Bauer, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/003,677

(22) Filed: Oct. 31, 2001

(65) Prior Publication Data

US 2003/0081034 A1 May 1, 2003

(51) Int. Cl.[7] ..... B41J 2/01
(52) U.S. Cl. ..... 347/14; 347/17; 347/60
(58) Field of Search ..... 347/11, 14, 17, 347/60

(56) References Cited

U.S. PATENT DOCUMENTS 4,704,620 A * 11/1987 Ichihashi et al. ..... 347/18
5,475,405 A * 12/1995 Widder et al. ..... 347/14
5,917,509 A * 6/1999 Becerra et al. ..... 347/11

* cited by examiner

*Primary Examiner*—Craig Hallacher

(57) ABSTRACT

The present invention includes an embodiment for optimizing the temperature operating range for a thermal inkjet printhead using ink over large print swaths. In general, this embodiment includes receiving the temperature of a digital temperature sensor (DTS) before printing begins, comparing this temperature with the set point for printing, initiating heating elements if the temperature is below the printing threshold, and turning off those heating elements when the threshold temperature of the die has been reached. The method and process minimizes thermal excursions, either above or below the set point for the production of ink droplets, and maintains an approximate isothermal environment for operation.

27 Claims, 3 Drawing Sheets

SYSTEM AND METHOD FOR USING PULSE OR TRICKLE WARMING TO CONTROL NEUTRAL COLOR BALANCE ON A PRINT MEDIA

FIELD OF THE INVENTION

The present invention generally relates to printers and in particular to a system and method for using pulse or trickle warming to control neutral color balance on a print media.

BACKGROUND OF THE INVENTION

Inkjet printers print dots by ejecting very small drops of ink onto the print media and typically include a movable carriage that supports one or more print cartridges each having a printhead with a nozzle member having ink ejecting nozzles. In general, the ink is housed in a vaporization chamber with a tube leading to a nozzle exposed to the print media. Small drops of ink are ejected from the nozzles through orifices by rapidly heating a small volume of ink located in the vaporization chambers with small electric heaters, such as small thin film resistors.

Gas is held in solution in liquids such as ink. The colder the ink, the greater the amount of gas that is held. As the ink increases in temperature, the solubility of the gas decreases, and it leaves the solution in the form of bubbles. The higher the temperature, the more bubbles are formed, and they form at a faster rate. If the temperature reaches a sufficiently high temperature the solution itself may reach its boiling point and also form a gas. The bubbles from either source choke the nozzles and cause deterioration in the quality of the image on the print media.

Temperature also controls the uniformity of the drop size of the ejected ink. The heat from the resistors causing the explosive vaporization in the chamber also causes the size of the drop of ink formed in the chamber to vary. There is an optimal temperature operating range for printheads using inks. If the temperature is too low the ink droplets formed will be smaller and have a lower drop-weight than that required for good image quality. As the temperature rises, the drop-weight of the ink droplet will rise. The variation in drop weight varies with the ink being used. These variations in drop-weight will cause visible color shifts in the printed image.

The temperature will be high if the resistors fire a number of times in a short period of time. Also, if the length of the current pulse to the resistor is longer than a pre-determined limit. As the carriage traverses in a print swath, various heater elements in the array are activated. If the traverse is narrow, the mean temperature at the beginning of the traverse will be similar to the mean temperature at the conclusion, and the effect of temperature on the pass will be consistent for all ink droplets projected onto the print media. If the swath is wide, and more heater elements are activated, the mean temperature at the end of the pass may be considerably higher than at the beginning. The difference in temperature from the beginning of the pass to the end of the pass could result in variation in the drop-weight of ink droplets on the same pass. This would result in color variation on the one line of print.

Generally, the temperature of the printhead is approximated by two measurements, the thermal sense resistor (TSR), and the digital temperature sensor (DTS). The DTS is a point sensor located at the top of the die near a firing heating element. While this sensor more accurately reflects the temperature at that point, it is not an accurate measure for other heating elements on the die.

The TSR is an approximation of the mean temperature of the printhead die. It is not located adjacent to any particular heating element and reflects the temperature of the die after heat has moved from the heating elements to the TSR. There is, therefore, a delay in the temperature reported by the TSR. The longer the printhead fires, the greater will be the temperature recorded by the TSR. When the printhead has been idle, for example, at the beginning of a print pass, the temperature recorded by the TSR will be low as the die will be cool. The droplets produced at this time will be of low drop-weight. As the pass continues and the number of heating elements firing has increased, the temperature at the TSR will have increased and the drop-weight of the ink droplets will have increased. The difference in temperature from the beginning of the pass till the end of the pass will affect the size of the ink droplets across the pass.

To minimize the effect of temperature variance from the beginning of printing to another point in the printing process, a warming device may be employed. A warming device is used to raise the temperature of the printhead. The printhead assembly may include a means to control the electrical current to the firing resistors so that their temperature is below the threshold required to eject an ink drop. This device could be a power field effect transistor (FET). The device provides a capability to warm the printhead assembly to the desired temperature before or during printing operations. The process is called "trickle warming" because the printhead assembly allows only a trickle of energy to flow through separate FETs to firing resistors. The printhead assembly temperature rises until the desired temperature is reached and the warming device is then shut off. Other embodiments of the invention may employ a pulse warming system to effect a similar result.

However, these systems are problematic because they do not incorporate changes in either ambient temperature or ambient humidity in calculating the preferred droplet size to be printed to the print media. Ambient temperature and ambient humidity have an effect on the print media so that the absolute color consistency of printed images are affected by their change. The ink interacts with the print media, and if the physical nature of the print media has been altered by changes in the ambient conditions, then the interaction of inks with the print media will vary with each change. Therefore, what is needed is a system and method that overcomes these problems.

SUMMARY OF THE INVENTION

To overcome the limitations in the prior art described above, and to overcome other limitations that will become apparent upon reading and understanding the present specification, the present invention includes an embodiment for optimizing the temperature operating range for a thermal inkjet printhead using ink over large print swaths.

In general, this embodiment includes receiving the temperature of a digital temperature sensor (DTS) before printing begins, comparing this temperature with the set point for printing, initiating heating elements if the temperature is below the printing threshold, and turning off those heating elements when the threshold temperature of the die has been reached.

The method and process minimizes thermal excursions, either above or below the set point for the production of ink droplets, and maintains an approximate isothermal environment for operation. This in turn would lead to ink droplets of a consistent drop weight and would further lead to a consistent production of color. In the description that follows, color is referred to tone, hue and chroma. In one example, the system and method of the present invention can be implemented in a black and white system where the tone range is modified.

BRIEF DESCRIPTION OF THE DRAWINGS

The present invention can be further understood by reference to the following description and attached drawings that illustrate the preferred embodiment. Other features and advantages will be apparent from the following detailed description of the preferred embodiment, taken in conjunction with the accompanying drawings, which illustrate, by way of example, the principles of the invention.

DETAILED DESCRIPTION OF THE PREFERRED EMBODIMENTS

In the following description of the invention, reference is made to the accompanying drawings, which form a part hereof, and in which is shown by way of illustration a specific example in which the invention may be practiced. It is to be understood that other embodiments may be utilized and structural changes may be made without departing from the scope of the present invention.

I. General Overview

Figure 1:
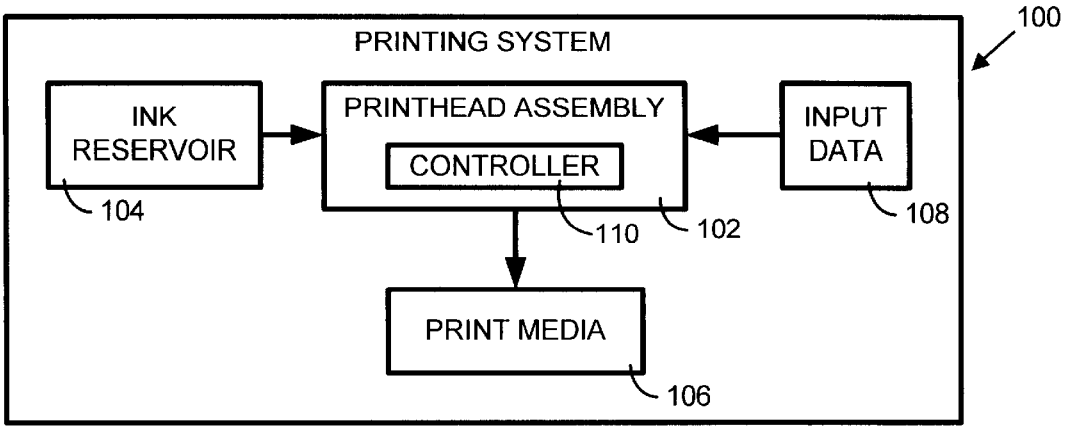
FIG. 1 shows a block diagram of an overall printing system incorporating the present invention.

FIG. 1 shows a block diagram of an overall printing system incorporating the present invention. The printing system 100 of the present invention includes a printhead assembly 102, ink supply 104 and print media 106. Input data to the printing system 100 comes from the input data channel 108. A temperature controller system 110 is included in the printhead assembly 102. The controller system 110 can be an integrated circuit, firmware, a software printer driver or the like and controls an increase in the mean temperature of the substrate or semiconductor wafer (used interchangeably with die) of the printhead through a feedback loop. The loop activates the heating elements and therefore increases the baseline temperature of the die before printing, and in turn decreases the temperature differential between the baseline temperature and the mean temperature of the die.

In general, the controller system 110 maintains the mean temperature of certain printhead components, such as the substrate or die, at a temperature that is within a predefined range of an optimal temperature for the production of a droplet of ink. In one embodiment, there are printheads 102 for black inks and colored inks. Each printhead 102 has a DTS feedback loop. The controller receives additional feedback of ambient temperature and humidity sensors. With this data, droplet production is adjusted by optimizing the temperature set point of each printhead 102. A nominal increase in the temperature would increase the degree of color, while a decrease in temperature would produce less color. The manipulation of color through this system and method would therefore improve image quality via the mass of droplets.

Further, sensory information is received by the controller 110 from the color sensors of the print media 106. Adjustments to baseline set points can be made to achieve neutral color balance on the print media 106. This will result in improved conformity of the drop-weight of ink droplets and neutral color balance on the print media. The image produced by this system and method will be a more accurate color rendition of the input data.

Therefore, as will be described and explained below, the invention allows for changes in climatic conditions, or media type, where inks are printed to print media and includes a warming system and method to control the size of ink droplets, in relation to the ambient temperature and/or humidity, and/or media type, so that a neutral color balance is maintained. In another embodiment, the invention detects neutral color balance printed on the print media and corrects the color if deviations from neutral color balance occur.

II. Exemplary Printing System

Figure 2:
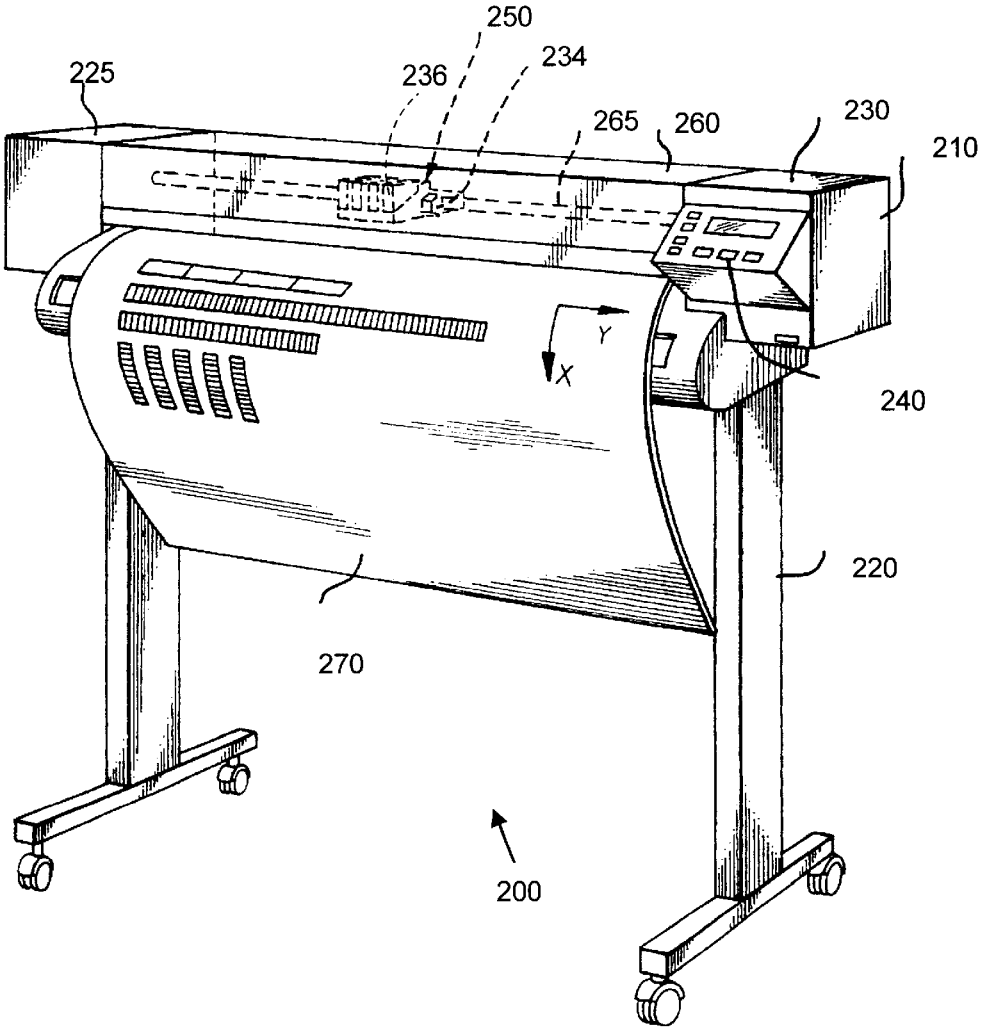
FIG. 2 is an exemplary printer that incorporates the invention and is shown for illustrative purposes only.

FIG. 2 is a perspective view of an exemplary high-speed large format printing system 200 that incorporates the invention and is shown for illustrative purposes only. The printing system 200 includes a housing 210 mounted on a stand 220. The housing 210 has a left media transport mechanism cover 225 and a right media transport mechanism cover 230 housing a left media transport mechanism (not shown) and a right media transport mechanism (not shown), respectively. A control panel 240 is mounted on the right media transport mechanism cover 230 and provides a user interface with the printing system 200.

A printhead assembly 102 with print cartridges 236 is mounted on a carriage assembly 234, all being shown under a transparent cover 260. The carriage assembly 234 positions the printhead assembly 102 along a carriage bar 265 in a horizontal direction denoted by the "y" axis A print media 106 (such as paper) is positioned by the media transport mechanism (not shown) in a vertical direction denoted by the "x" axis.

The present invention is equally applicable to alternative printing systems (not shown) such as those incorporating smaller format printers or grit wheel or drum technology to support and move the print media 106 relative to the printhead assembly 102. With a grit wheel design, a grit wheel and pinch roller move the media back and forth along one axis while a carriage carrying one or more printheads scans past the media along an orthogonal axis. With a drum printer design, the media is mounted to a rotating drum that is rotated along one axis while a carriage carrying one or more printheads scans past the media along an orthogonal axis. In either the drum or grit wheel designs, the scanning is typically not done in a back and forth manner as is the case for the system depicted in FIG. 2.

The print cartridges 236 may be removeably mounted or permanently mounted to the scanning carriage 234. Also, the print cartridges 236 can have self-contained ink reservoirs in the body of the printhead (shown in FIG. 3) as the ink supply 104 (shown in FIG. 1). The self-contained ink reservoirs can be refilled with ink for reusing the print cartridges 236. Alternatively, the print cartridges 236 can be each fluidically coupled, via a flexible conduit 240, to one of a plurality of fixed or removable ink containers 242 acting as the ink supply 104 (shown in FIG. 1). As a further alternative, ink supplies 104 can be one or more ink containers separate or separable from print cartridges 236 and removeably mountable to carriage 234.

Figure 3:
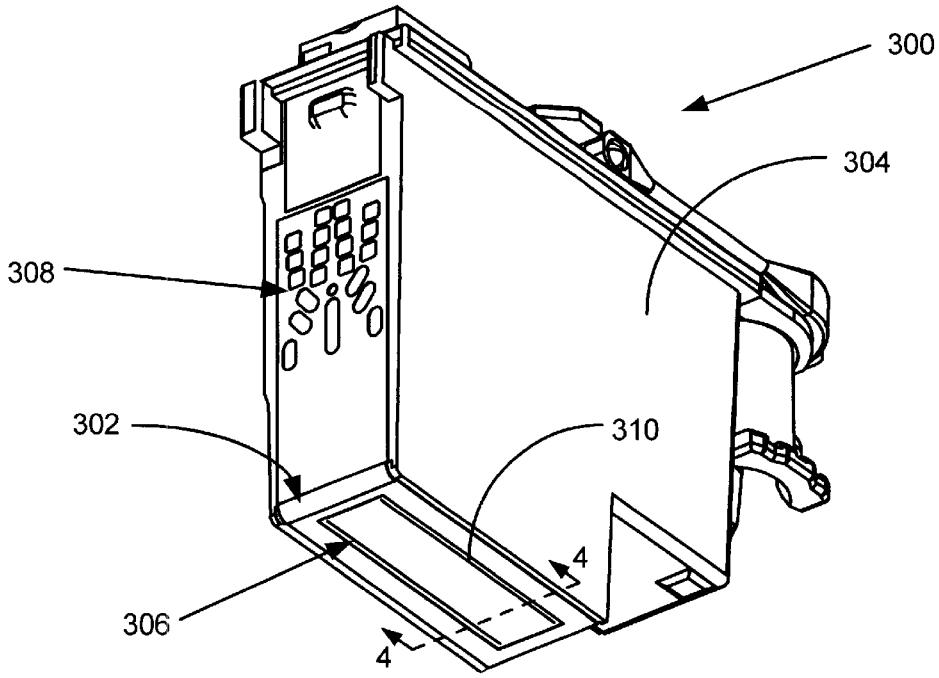
FIG. 3 shows for illustrative purposes only a perspective view of an exemplary print cartridge incorporating the present invention.

FIG. 3 shows for illustrative purposes only a perspective view of an exemplary printhead assembly 300 (an example of the printhead assembly 102 of FIG. 1) incorporating the present invention. A detailed description of the present invention follows with reference to a typical printhead assembly used with a typical printer, such as printer 200 of FIG. 2. However, the present invention can be incorporated in any printhead and printer configuration.

Referring to FIGS. 1 and 2 along with FIG. 3, the printhead assembly 300 is comprised of a thermal head assembly 302 and a printhead body 304. The thermal head assembly 302 can be a flexible material commonly referred to as a Tape Automated Bonding (TAB) assembly. The thermal head assembly 302 contains a flexible nozzle member 306 and interconnect contact pads (not shown) and is secured to the printhead assembly 300. The thermal head assembly 302 can be secured to the print cartridge 300 with suitable adhesives. An integrated circuit chip (not shown) provides feedback to the printer 200 regarding certain parameters of the printhead assembly 300. The contact pads align with and electrically contact electrodes (not shown) on carriage 234. The nozzle member 306 preferably contains plural parallel rows of offset nozzles 310 through the thermal head assembly 306 created by, for example, laser ablation. It should be noted that other nozzle arrangements can be used, such as non-offset parallel rows of nozzles.

III. Component Details

Figure 4:
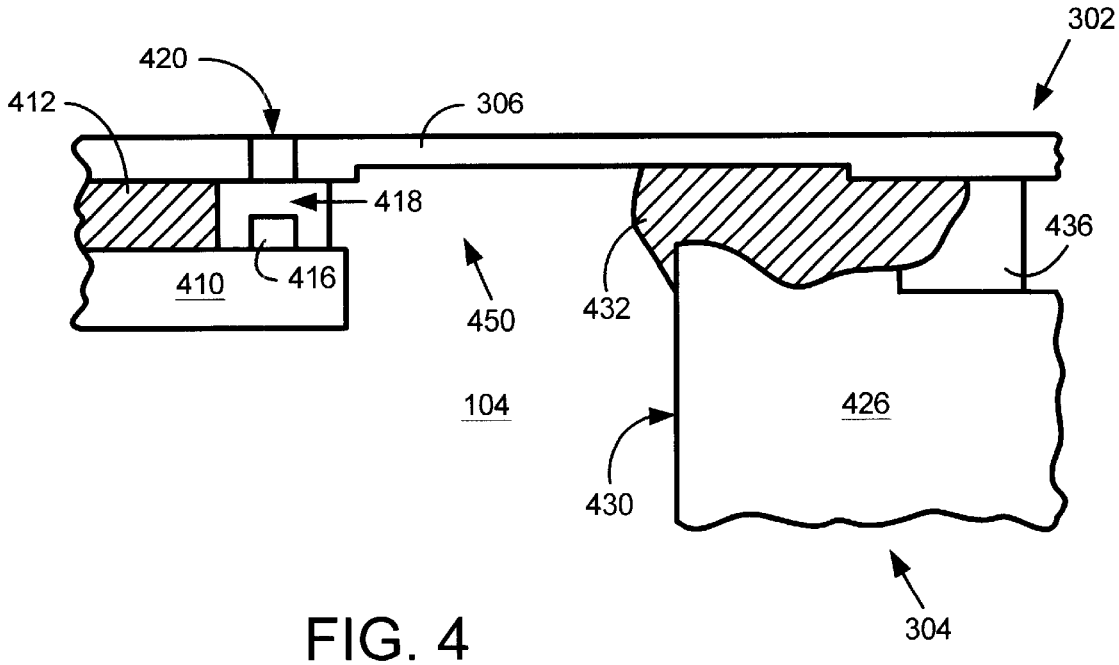
FIG. 4 is a schematic cross-sectional view taken through section line 4—4 of FIG. 3 showing the ink chamber arrangement of the print cartridge of FIGS. 1 and 3.

FIG. 4 is a cross-sectional schematic taken through section line 4—4 of FIG. 3 of the inkjet print cartridge 300 utilizing the present invention. A detailed description of the present invention follows with reference to a typical printhead used with print cartridge 300. However, the present invention can be incorporated in any printhead configuration. Also, the elements of FIG. 4 are not to scale and are exaggerated for simplification.

Referring to FIGS. 1–3 along with FIG. 4, as discussed above, conductors (not shown) are formed on the back of thermal head assembly 302 and terminate in contact pads for contacting electrodes on carriage 234. The other ends of the conductors are bonded to the printhead 302 via terminals or electrodes (not shown) of a substrate 410, such as a semiconductor material, commonly referred to as a die. The substrate or die 410 has ink ejection elements 416 formed thereon and electrically coupled to the conductors. The integrated circuit chip provides the ink ejection elements 416 with operational electrical signals. A barrier layer 412 is located between the nozzle member 306 and the substrate 410 for insulating conductive elements from the substrate 410.

An ink ejection or vaporization chamber 418 is adjacent to each ink ejection element 416, as shown in FIG. 4, so that each ink ejection element 416 is located generally behind a single orifice or nozzle 420 of the nozzle member 306. The nozzles 420 are shown in FIG. 4 to be located near an edge of the substrate 410 for illustrative purposes only. The nozzle 420 can be located in other areas of the nozzle member 306, such as centered between an edge of the substrate 410 and an interior side of the body 304.

Each ink ejection element 416 acts as an ohmic heater when selectively energized by one or more pulses applied sequentially or simultaneously to one or more of the contact pads via the integrated circuit. The ink ejection elements 416 may be heater resistors or piezoelectric elements and for the purposes of the current invention will be heater resistors. The orifices 420 may be of any size, number, and pattern, and the various figures are designed to simply and clearly show the features of the invention. The relative dimensions of the various features have been greatly adjusted for the sake of clarity.

Referring to FIGS. 1–4, during a printing operation, ink stored in an ink reservoir 104 defined by the printhead body 304 generally flows around the edges of the substrate 410 and into the vaporization chamber 418. Energization signals are sent to the ink ejection element 416 and are produced from the electrical connection between the print cartridges 236 and the printer 200. Upon energization of the ink ejection element 416, a thin layer of adjacent ink is superheated.

The ideal temperature for ejecting a droplet is about 50 degrees Celsius, but the heating element can reach a temperature of 500 degrees Celsius in 3 microseconds. If the controller fires a number of times in a short period, or the pulse of the firing was lengthened, the heating element would reach a temperature above that required to produce the correct sized ink drop. The energized heater element causes explosive vaporization and, consequently, causes a droplet of ink to be ejected through the orifice or nozzle 420. The vaporization chamber 418 is then refilled by capillary action. This process enables selective deposition of ink on print media 106 to thereby generate text and images. As such, when the printhead assembly 300 is scanned across the print media during printing, variations in the size or physical nature of the ink droplet will affect the location and/or the action of the ejected ink on the print media and therefore affect the quality of printing.

A. Controller System

Figure 5:
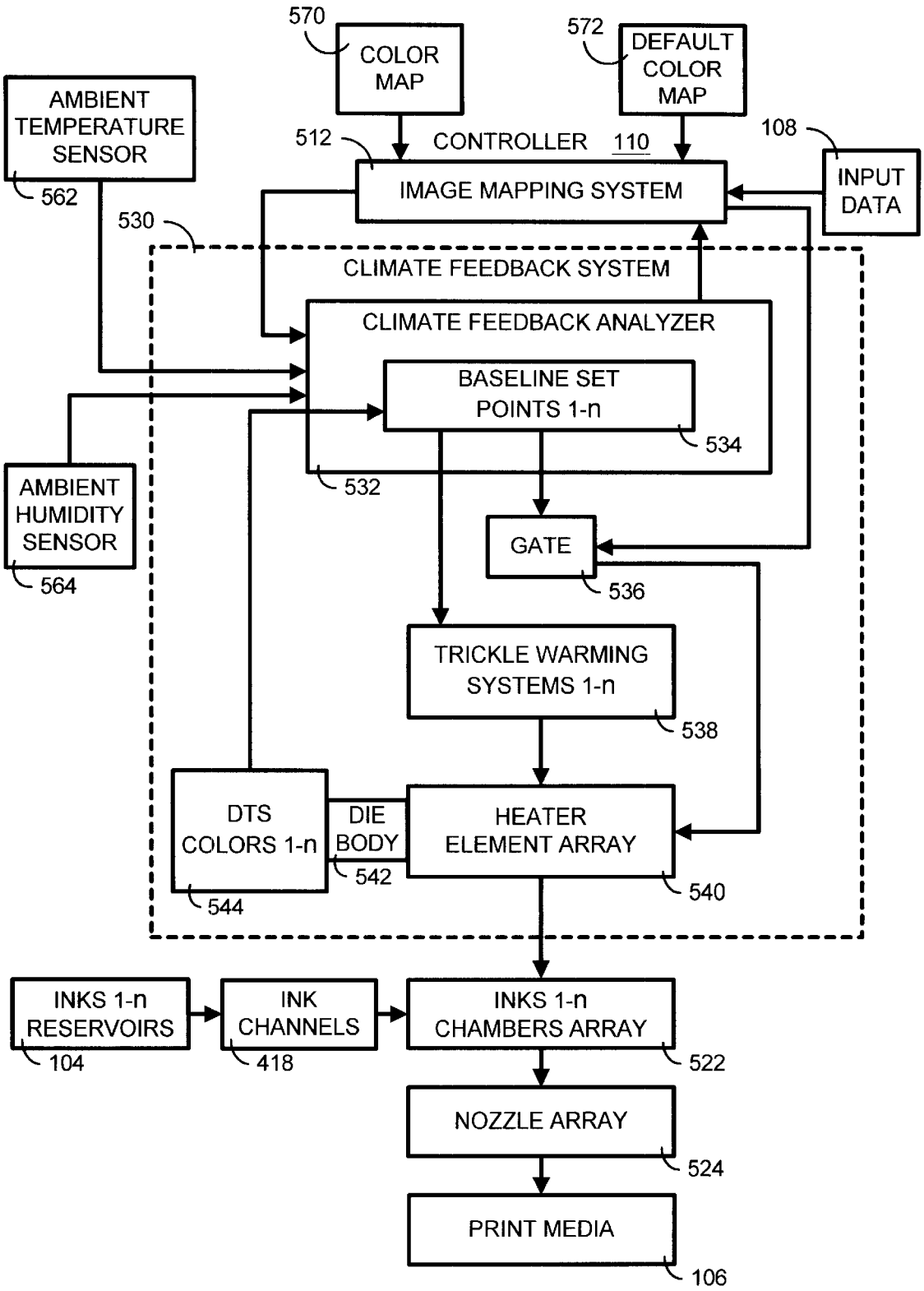
FIG. 5 shows a block diagram of the temperature sensor layout on the printhead incorporated in the present invention.

FIG. 5 is a block diagram illustrating the operation and integration of the printhead assembly 102 of FIG. 1. Referring to FIGS. 1–4 along with FIG. 5, during a printing operation, ink is provided from the ink supply to an interior portion, such as an ink reservoir 104 of the printhead body 304. The interior portion of the printhead body 304 provides ink to the ink channels 418 for allowing ejection of ink from the vaporization chambers through adjacent nozzles 420. Namely, the printhead assembly 102 receives commands from the controller 110 to print ink based on the input data 108 and form a desired pattern for generating text and images on the print media 106. Print quality of the desired pattern is dependent on accurate placement and the correct weight of the ink droplets on the print media 106.

One way to increase print quality using inks, is to adjust the temperature and size of the droplet to conform with the physical properties of the print media. This can be achieved by producing droplets at an optimal temperature. In one embodiment, the ideal temperature for ejecting a droplet varies with the ink that is being heated and the print media on which it is printed. In this embodiment, the ideal temperature for black ink is 40 degrees centigrade, and 45 degrees centigrade for colored ink. Below these temperatures, the ink drop weight would be lower than that required for an ideal ink droplet. If the temperature rises over 50 degrees centigrade, the risk of nozzle choking through bubble formation becomes a real possibility. Some control must therefore be exercised to keep temperatures within a limit to achieve neutral color balance for the print media.

To achieve this, in one embodiment of the present invention, the controller 110 includes a feedback system 530 that defines the baseline operating temperature of the printhead and the optimal temperature and humidity for the ink 1-n and media system. The feedback system 530 is a controller that receives the temperature of 1 or 1-n digital temperature sensor(s) (DTS) 544, ambient temperature sensor 562, and the ambient humidity sensor 654. This information is analyzed together with the media input 531 data. For these parameters a color map 572 is calculated. This default color map 572 has a relative accuracy to a color map for ambient measures of 25 degrees centigrade temperature and 50% relative humidity.

The calculations for the temperature or temperatures of a particular die sector or sectors 542 are determined for the optimal temperature of the default color map 572 for the ink(s) in that sector. These temperatures may be in the form of a look up table in a feedback analyzer 532 where the optimal temperature of an ink is a function of temperature, humidity, and media type. If the temperature(s) is below the threshold baseline temperature, the temperature feedback system 530 inactivates the heater element array 540 by switching the gate 536. The system and method minimizes the thermal excursions of the printhead above or below the set points for the various inks. The feedback analyzer 532 can be updated dynamically for changing and updating the look up table.

In a closed loop embodiment, a calorimeter can be used to measure predetermined printed areas. Deviations from the ideal color can then be compensated by adjusting the thermal set points. A look up table or function can be used to relate color deviations to the desired set point deviations. In one embodiment, the color sensor 580 monitors predefined colors for neutral color balance. If the sensor perceives a color not to be a neutral color then isothermal printhead heating set points are modified using a look up table to maintain a neutral color balance. The changes in thermal set points are based on a predefined relationship between the printhead temperature and color. The predefined relationship can be any suitable system for modeling the correlation between temperature and color.

When the printing system 100 is activated the warming system 538 is turned on. This warming system 538 remains activated till the optimal temperature is reached. The warming system 538 can use any suitable warming device and can include a controller for controlling the electrical current to the firing resistors so that their temperature is below the threshold required to eject an ink drop. This device could be a power field effect transistor (FET). The FET device could provide the capability to warm the printhead assembly to the desired temperature before or during printing operations.

When the temperature reaches the optimal set point a gate or switch 536 is opened so that the heater element array 540 can be activated. This system allows ink droplets being ejected from an associated ink chamber 522 to be at a preferred temperature for associated flowing ink. The ink droplets will more closely approximate ideal drop weight, so that the ink hue will be more consistent across the print swath.

B. Temperature Feedback System

Referring to FIGS. 1–5, the input data 108 relates to the actual printed information on the print media 106. Locations of the printed output correspond to the input data 108. Each location represents a small dot in a rectilinear array. The locations vary in size and are related to the pixels of the image of the input data 108 that is to be printed on the print media 106. Smaller dots in the rectilinear array means that more dots can be printed per inch of the printed media and require a greater number elements in the heater element array 540 being fired.

The input data 108 is received by the image mapping system 512. The image mapping system 512 defines the pixel coordinates, the number and size of pixels to be produced, the colors of each pixel, and the color densities of each pixel as a color map 570. Information regarding pixels that require either black ink or the various colored inks is conveyed to the heater element array 540 through a temperature controlled gate 536. The elements of the heater element array 536 would be specific for the various colors to be printed which could include black and the various combinations of base colors in the cartridges in the printhead(s) 236. The colors that could be printed range from 1-n. The various inks required to produce colors may have differing baseline set points, 1-n, 534.

DTS region sensors (1-n) 544 sense the temperature of the heater elements on the heater element array 540 through the die body 542. The DTS region sensors, 1-n, 544 reflect the temperatures of the various heater elements, 1-n, 540 that heat the chambers in the ink chamber array (1-n) 522 for the various inks. The feedback analyzer 532 monitors and observes temperatures of the DTS region sensors 544, and co-ordinates this information with that received from the ambient sensors, temperature 562, and relative humidity 564.

Information from the sensors is directed to the baseline set point (1-n) 534. The baseline set point 1-n 534 calculates the parameters for the default color map (which may be in the form of a look up table) and activates respective warming systems 1-n 538 if any measured temperature is below the threshold determined for that particular ink. As the printer continues to print, the feedback analyzer 532 continues to monitor the temperature through the DTS sensors 544 and external sensors, and adjusts the warming system, 1-n, 538 accordingly, until the plot is finished. The warming system 538 warms the die 542 to the threshold temperature, and at this point the DTS region sensor 544 forwards the temperature to the feedback analyzer 532, which opens the gate 536. This in turn activates the respective elements in the heater element array 540.

The heater elements will heat, and ink in the respective chamber array 522 will vaporize. Black ink droplets closer to optimal weights will be ejected from the black nozzles in the nozzle array 524, to the print media 106. Similarly, color droplets are produced on the print media 106 from the color nozzles in the nozzle array 524.

IV. Conclusion

In conclusion, a dynamic and proactive printhead assembly is established through the temperature feedback system 530. This helps maintain the die at an optimum temperature for producing droplets in inks. The net effect is that a better quality of color will be produced. Consequently, the controller 110 maintains the printhead assembly 102 at a mean temperature that more closely approximates the optimal temperature for the formation of ink droplets. As such, activation of the warming system (1-n) 538 is conducted in a more efficient and effective manner. The heater element array 540, and the nozzle array 524 create a pattern of ink droplets across a swath. The reproduction of the image on the print media 106 based on the input data 108 would have less color shifts across the swath.

The foregoing has described the principles, preferred embodiments and modes of operation of the present invention. However, the invention should not be construed as being limited to the particular embodiments discussed. The above-described embodiments should be regarded as illustrative rather than restrictive, and it should be appreciated that variations may be made in those embodiments by workers skilled in the art without departing from the scope of the present invention as defined by the following claims.

What is claimed is:

1. A method for printing ink drops with a printhead over a print swath, comprising:

receiving a temperature of the printhead before printing begins;

comparing the temperature with a predefined set point threshold temperature for printing;

initiating heating elements if the temperature is below the threshold temperature;

turning off the heating elements when the threshold temperature of the printhead has been reached; and producing ink droplets of a consistent drop weight with neutral color balance.

2. The method of claim 1, further comprising using a look up table to control the heating elements through a feedback system to produce an optimized temperature range for the ink drops.

3. The method of claim 2, wherein the look up table is incorporated in a controller of the printhead.

4. The method of claim 2, wherein the look up table is a pre-programmable scheme addressing the functions of ambient temperature, ambient humidity, and print media type.

5. The method of claim 1, wherein the ink drops are fired onto a print media in accordance with a color map in a controller.

6. The method of claim 5, wherein the feedback system controls pixel locations of the color map.

7. The method of claim 2, further comprising using temperature data for each sector of the heater elements by the feedback system.

8. The method of claim 4, further comprising using data from the look up table by an image mapping system to produce a default color map.

9. The method of claim 1, further comprising establishing baseline temperature set points to produce neutral color balance for the ink drops.

10. The method of claim 1, further comprising providing a warming system for optimizing the temperatures of the heater elements so that they are at an isothermal level to produce neutral color balance for ink drops.

11. A printhead for printing ink drops over a print swath, comprising:

a sensor that receives a temperature of the printhead before printing begins; and a controller that compares the temperature with a predefined set point threshold temperature for printing, initiates heating elements if the temperature is below the threshold temperature and adjusts the heating elements until the threshold temperature of the printhead has been reached to produce ink droplets of a consistent drop weight with neutral color balance.

12. The printhead of claim 11, wherein the controller includes a feedback system that produces an optimized temperature range for the ink drops with a look up table to control the heating elements.

13. The printhead of claim 12, wherein the look up table is a pre-programmable scheme addressing the functions of ambient temperature, ambient humidity, and print media type.

14. The printhead of claim 13, wherein the feedback system controls pixel locations of the color map.

15. The printhead of claim 11, further comprising a color map coupled to the controller and used when firing the ink drops onto a print media.

16. The printhead of claim 11, further comprising an open loop system that is based on at least one of current print media type, temperature, and humidity, and a predefined look up that modifies isothermal printhead heating set points to maintain a neutral color balance.

17. The printhead of claim 11, further comprising a closed loop system, wherein the sensor monitors predefined colors for neutral color balance.

18. The printhead of claim 17, wherein if the sensor perceives a color not to be a neutral color then isothermal printhead heating set points are modified using a look up table to maintain a neutral color balance.

19. The printhead of claim 11, wherein color includes at least one of tone, hue and chroma.

20. The printhead of claim 11, wherein color includes black and white colors with tone range modifications.

21. A method for printing ink drops over a print swath, comprising:

comparing a pre-sensed temperature of a printhead with a predefined set point threshold temperature for printing;

determining if the temperature is below the threshold temperature and initiating heating elements when below the threshold; and adjusting the heating elements until the threshold temperature of the printhead has been reached to produce ink droplets of a consistent drop weight with neutral color balance.

22. The method of claim 21, further comprising providing an open loop system that is based on at least one of current print media type, temperature, and humidity, and a predefined look up that modifies isothermal printhead heating set points to maintain a neutral color balance.

23. The method of claim 21, further comprising providing a closed loop system, wherein the sensor monitors predefined colors for neutral color balance.

24. The method of claim 21, further comprising producing an optimized temperature range for the ink drops to control the heating elements.

25. The method of claim 24, further comprising using a pre-programmable scheme addressing the functions of ambient temperature, ambient humidity, and print media type.

26. The method of claim 21, wherein color includes at least one of tone, hue and chroma.

27. The method of claim 21, wherein color includes black and white colors with tone range modifications.

* * * * *